US008684134B2

(12) United States Patent
Dugan et al.

(10) Patent No.: US 8,684,134 B2
(45) Date of Patent: Apr. 1, 2014

(54) GYPSUM-PANEL ACOUSTICAL MONOLITHIC CEILING

(71) Applicant: USG Interiors, LLC, Chicago, IL (US)

(72) Inventors: Erin Dugan, Grayslake, IL (US); Mark Miklosz, Western Springs, IL (US); Rafael Bury, Wheeling, IL (US); Lee K. Yeung, Vernon Hills, IL (US); William A. Frank, Lake Villa, IL (US)

(73) Assignee: USG Interiors, LLC, Chicago, IL (US)

( * ) Notice: Subject to any disclaimer, the term of this patent is extended or adjusted under 35 U.S.C. 154(b) by 0 days.

(21) Appl. No.: 13/832,107

(22) Filed: Mar. 15, 2013

(65) Prior Publication Data

US 2014/0000979 A1 Jan. 2, 2014

Related U.S. Application Data

(63) Continuation-in-part of application No. 13/534,454, filed on Jun. 27, 2012.

(51) Int. Cl.
*E04B 1/82* (2006.01)
*E04B 2/02* (2006.01)

(52) U.S. Cl.
USPC ..... 181/290; 181/291; 181/293

(58) Field of Classification Search
USPC ..... 181/290, 291, 293; 52/144, 145
See application file for complete search history.

(56) References Cited

U.S. PATENT DOCUMENTS

| | | | |
|---|---|---|---|
| 2,045,311 | A | 6/1936 | Roos et al. |
| 2,126,956 | A | 8/1938 | Gilbert |
| 2,307,978 | A | 1/1943 | Williams |
| 2,814,080 | A | 11/1957 | Tvorik et al. |
| 4,040,213 | A | 8/1977 | Capaul |
| 4,135,341 | A | 1/1979 | Johnson et al. |
| 4,222,803 | A | 9/1980 | Kent et al. |
| 4,347,912 | A | 9/1982 | Flocke et al. |
| 4,428,454 | A | 1/1984 | Capaul et al. |
| 4,661,161 | A | 4/1987 | Jakacki et al. |

(Continued)

FOREIGN PATENT DOCUMENTS

| | | |
|---|---|---|
| DE | 3147174 A1 | 6/1983 |
| EP | 2591181 | 1/2012 |

(Continued)

OTHER PUBLICATIONS

Notification of Transmittal of the International Search Report and the Written Opinion of the International Searching Authority, or the Declaration of PCT/US2013/047280, filed Jun. 24, 2013, International Search Report dated Oct. 9, 2013, Written Opinion of the International Searching Authority.

*Primary Examiner* — Jeremy Luks
(74) *Attorney, Agent, or Firm* — Pearne & Gordon LLP

(57) ABSTRACT

An acoustical panel for forming a monolithic ceiling or wall, the panel extending across a rectangular area, and having a core made primarily of gypsum, the core being essentially coextensive with the panel area such that it has two opposed sides, each of an area substantially equal to the area of the panel, the core having a multitude of perforations extending generally between its sides, the perforations being distributed substantially uniformly across the full area of the core and being open at both sides of the core, the face side of the core being covered by a porous layer, the perforations being optionally restricted at a rear side of the core, the porous layer at the face side of the core being suitable for adherence of drywall joint compound and a water-based non-blocking paint.

9 Claims, 4 Drawing Sheets

(56) References Cited

U.S. PATENT DOCUMENTS

| | | | |
|---|---|---|---|
| 4,830,140 | A | 5/1989 | Fridh et al. |
| 5,178,939 | A | 1/1993 | Caldwell |
| 5,336,318 | A | 8/1994 | Attard et al. |
| 5,558,710 | A | 9/1996 | Baig |
| 5,674,594 | A | 10/1997 | Sensinig |
| 5,725,656 | A | 3/1998 | Shimanovich et al. |
| 5,746,822 | A | 5/1998 | Espinoza et al. |
| 6,228,163 | B1 | 5/2001 | Espinoza et al. |
| 6,284,351 | B1 | 9/2001 | Sensenig |
| 6,675,551 | B1 | 1/2004 | Fuchs |
| 7,503,430 | B2 | 3/2009 | Englert et al. |
| 7,661,511 | B2 | 2/2010 | Hasegawa et al. |
| 7,703,243 | B2 | 4/2010 | Baig |
| 7,836,652 | B2 | 11/2010 | Futterman |
| 7,851,057 | B2 | 12/2010 | Englert et al. |
| 7,906,205 | B2 | 3/2011 | Meres |
| 8,100,226 | B2 | 1/2012 | Cao et al. |
| 8,210,310 | B1 | 7/2012 | Yeung et al. |
| 2005/0193668 | A1 | 9/2005 | Hamilton |
| 2005/0211500 | A1 | 9/2005 | Wendt et al. |
| 2007/0051062 | A1 | 3/2007 | Baig et al. |
| 2007/0102237 | A1 | 5/2007 | Baig |
| 2007/0186493 | A1 | 8/2007 | Baig |
| 2008/0245026 | A1 | 10/2008 | Hamilton |
| 2009/0094922 | A1 | 4/2009 | Newton et al. |
| 2010/0300025 | A1 | 12/2010 | Houck et al. |
| 2011/0076470 | A1 | 3/2011 | Zaveri |
| 2012/0240486 | A1 | 9/2012 | Borroni |
| 2013/0133978 | A1 | 5/2013 | Borroni |

FOREIGN PATENT DOCUMENTS

| | | | |
|---|---|---|---|
| GB | 2203772 | A | 10/1988 |
| JP | 58-218538 | A | 12/1983 |
| WO | 2010/105655 | A1 | 9/2010 |

GYPSUM-PANEL ACOUSTICAL MONOLITHIC CEILING

This application is a continuation-in-part of application Ser. No. 13/534,454, filed Jun. 27, 2012.

BACKGROUND OF THE INVENTION

The invention relates to building materials and systems and, in particular, to an acoustical panel for constructing monolithic ceilings and interior walls.

PRIOR ART

Sound absorption in buildings is commonly achieved with ceiling tiles carried on a suspended grid. Generally, the sound absorbing capacity of the tiles is achieved by material selection and/or characteristics of the room facing surface. Ceiling tile installations have the advantage of affording ready access to the space above the ceiling, but the divisions between the tiles, even when the grid is concealed, remain visible. Architects and interior designers have long sought a monolithic, texture free look in an acoustical ceiling particularly when there is no expected need for access to the space above the ceiling. Ordinary gypsum panel drywall ceiling construction does not achieve a sufficiently high noise reduction coefficient (NRC) that would qualify as acoustical. Perforated gypsum panels may achieve an acceptable NRC level but they are not monolithic in appearance.

SUMMARY OF THE INVENTION

The invention resides in the discovery that ordinary gypsum panels, such as drywall sheets, can be modified to construct an acoustical ceiling or wall with a monolithic plain face and surprising acoustical properties. Such panels can achieve an NRC of 0.70 or more.

In accordance with the invention, the gypsum core is made with a multitude of perforations or holes distributed throughout its planar area. The perforations or holes are restricted, preferably with a painted non-woven porous scrim fabric or veil at the front face and, optionally, a non-woven porous acoustical fabric at the back side.

The gypsum panel can be made, for example, by perforating standard sheets of drywall and thereafter covering the perforated sides of the sheet with additional laminated sheets or layers. These perforating and laminating steps can be performed by the original manufacturer of the drywall sheets or by a separate entity independent of the original drywall manufacturer.

Variations in the construction of the gypsum panel are contemplated. Common among these variations is a panel with a perforated gypsum core and with a face covered by a structure that is porous while appearing essentially imperforate to the unaided eye.

The disclosed gypsum-based panels can be installed in the same manner or a like manner as ordinary drywall. For ceiling applications, the acoustical panels of the invention can be screwed to a conventional drywall suspension system of grid tees or "hat channels" carried on black iron channels typically used in commercial applications or they can be attached to wood framing more often used in residential construction. Acoustical walls can be built by attaching the inventive acoustical panels to vertical studs, serving as spaced support elements. It will be seen that the inventive panels can be readily taped and painted like ordinary drywall, using the same or similar materials, equipment, tools and skills, to produce a smooth monolithic ceiling or wall.

DESCRIPTION OF THE PREFERRED EMBODIMENTS

Figure 1:
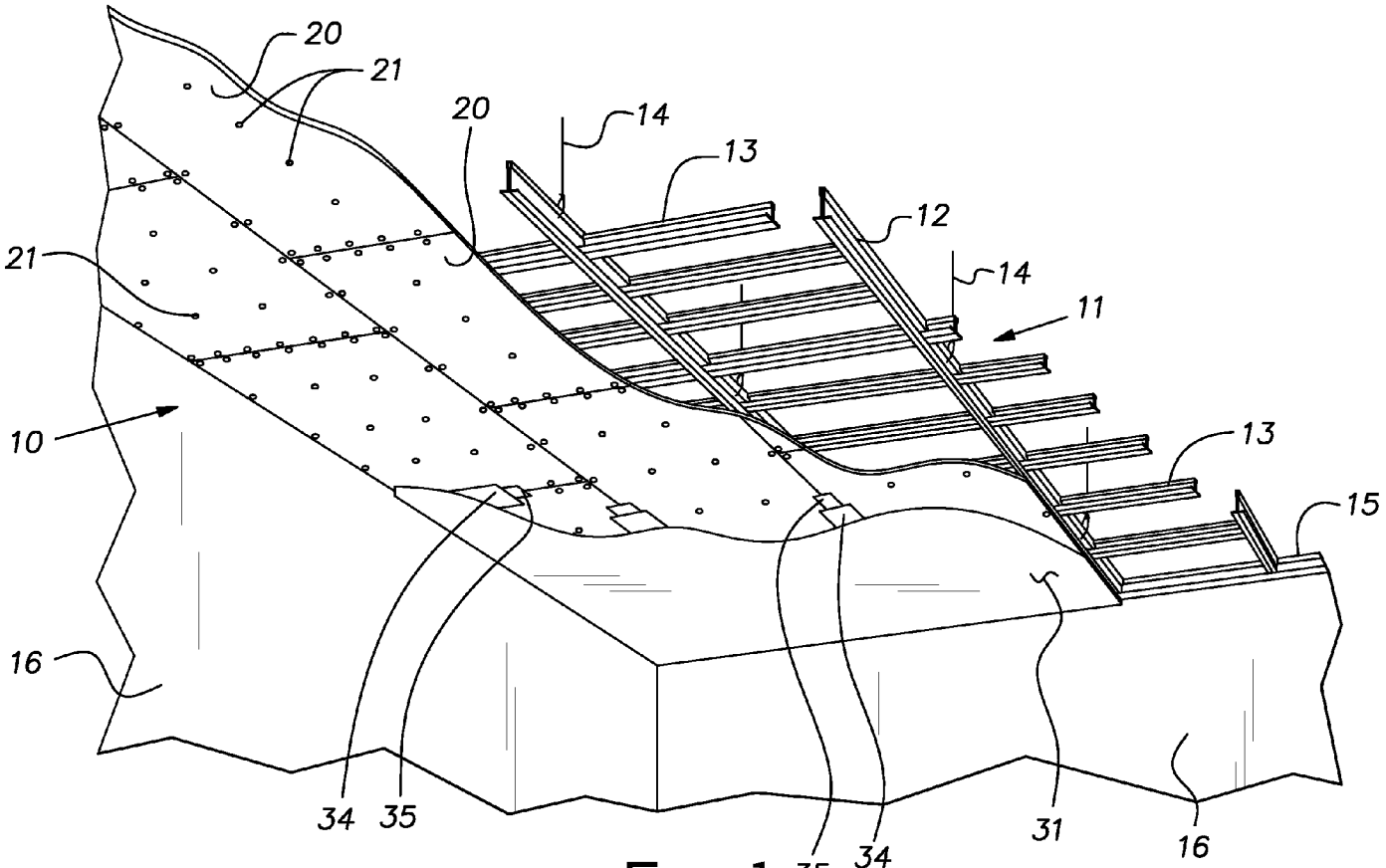
FIG. 1 is a fragmentary, schematic, isometric view of a monolithic acoustical ceiling.

Referring now to FIG. 1, there is shown a schematic partial view of an acoustical monolithic ceiling installation 10. Portions of layers of the ceiling 10 are peeled away to reveal constructional details. The ceiling 10 is a suspended system including a drywall grid 11, known in the art, comprising main tees 12 spaced on 4 ft. centers and intersecting cross tees 13 spaced on 16 in. or 2 ft. centers. Dimensions used herein are typically nominal dimensions and are intended to include industry recognized metric equivalents. The main tees 12, to which the cross tees 13 are interlocked, are suspended by wires 14 attached to a superstructure (not shown). A perimeter of the grid 11 is conventionally formed by channel molding 15 secured to respective walls 16.

Acoustical panels 20 are attached to the lower sides of the grid tees 12, 13 with self-drilling screws 21. The illustrated acoustical panels are 4 ft. by 8 ft. in their planar dimensions, but can be longer, shorter and/or of different width as desired or practical. The size of the panel 20 and spacing of the grid tees 12 and 13, allows the edges of the panel to underlie and be directly attached to a grid tee, assuring that these edges are well supported.

Figure 2:
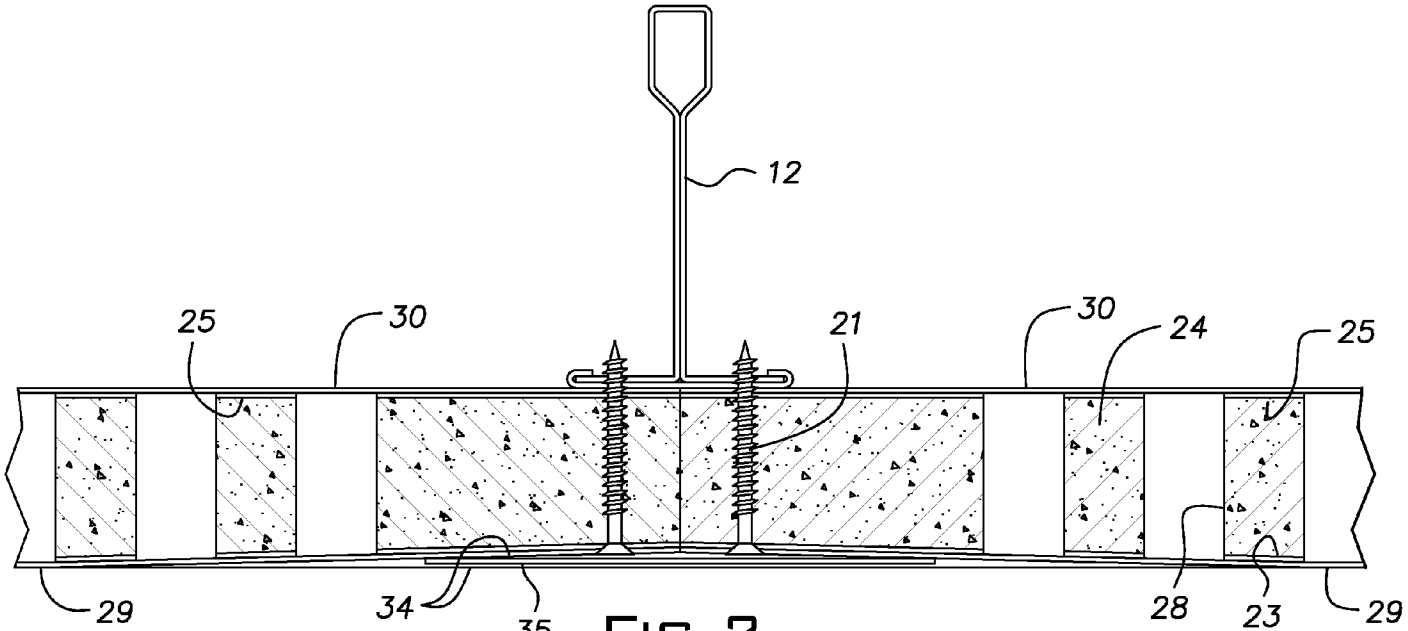
FIG. 2 is a fragmentary, cross-sectional view, on an enlarged scale, of the monolithic ceiling.

Referring to FIG. 2, the acoustical panel 20 of the invention is characterized with a perforated gypsum core 24. One method of providing the core 24 is to modify a standard commercially available sheet of drywall by perforating it through a front paper face 23, the gypsum core 24, and a rear paper side or face 25. Perforations 28 can be formed by drilling, punching, or with other known hole-making techniques. The perforations 28 are preferably uniformly spaced; by way of an example, the perforations can be round holes of 8 mm diameter on 16 mm centers. This arrangement produces a total area of the perforations substantially equal to 20% of the full planar area of a panel 20. Other hole sizes, shapes, patterns and densities can be used. For example, tests have shown that a hole density of 9% of the total area can achieve good results. Marginal areas, as well as intermediate areas corresponding to centers of support grid, joists, or studs, of a sheet can be left unperforated to maintain strength at fastening points.

Sheets 29, 30 are laminated to both full sides of the perforated drywall sheet thereby at least partially closing both ends of the perforations 28. At a rear side of the drywall, the backer sheet or web 30 is preferably an acoustically absorbent non-woven fabric known in the acoustical ceiling panel art. By way of example, the backer fabric can be that marketed under the trademark SOUNDTEX® by Freudenberg Vliesstoffe KG. It has a nominal thickness of 0.2 to 0.3 mm and a nominal weight of 63 g/m$^2$. Specifically, the main components of this non-woven fabric example are cellulose and E-glass with a synthetic resin binder such as polyacrylate, poly(ethylene-CO-vinylacetate). Alternatively, for example, the backer sheet 30 can be a porous paper layer. The sheet 30 can be provided with a suitable adhesive for binding it to the rear paper side 25 of the modified drywall sheet 22.

At a front side of the drywall sheet 22, a sheet or web in the form of a non-woven fabric scrim layer 29 is attached with a suitable adhesive. The facing layer or sheet 29 is porous; a suitable material for this application is that used commercially as a cover or face for conventional acoustical ceiling panels. An example of this type of veil material is that marketed by Owens Corning Veil Netherlands B.V. under the product code A125 EX-CH02. This scrim fabric comprises hydrated alumina fiberglass filament, polyvinyl alcohol, and acrylate copolymer. The unpainted scrim 29 has a nominal weight of 125 g/m$^2$ and an air porosity, at 100 Pa, of 1900 l/m$^2$ sec. To avoid blocking the face scrim 29, the adhesive can be initially applied to the panel or sheet 22. The facing sheet 29 should be sufficiently robust to withstand field finishing operations described below. It should also be compatible with drywall joint compound or similar material and commercially available paints, typically water-based paints such as that described below.

Other usable veils 29 include the non-woven, glass fiber products marketed by Owens-Corning Veil Netherlands B.V. as A135EX-CY07 (nominal weight 135 g/m$^2$, air porosity at 100 Pa of 1050 l/m$^2$/sec) and A180EX-CX51 (nominal weight 180 g/m$^2$, air porosity at 100 Pa of 600 l/m$^2$/sec). All of the described veils are translucent and are incapable of visually concealing the perforations 28 unless painted or coated with a coating such as disclosed herein.

The panel 20 with other identical panels is hung on the grid 11 in the same manner as ordinary drywall is installed. Similarly, as shown in FIG. 1, joints 33 are taped in the same way as regular drywall is taped. Drywall joint compound or similar material 34 is used to adhere a tape or similar material 35 to adjacent margins of two abutting panels 20 by applying it directly to the sheets 29 and over the tape 35 to conceal the tape. Typically, the long edges of the panels 20 are tapered to receive the joint tape 35 below the plane of the major part of the panel faces. The joint compound 34 can be conventional drywall joint compound and the tape 35 can be conventional drywall paper or mesh tape. The screws 21 securing the panels 20 to the spaced support elements 12, 13 forming the grid 11 are countersunk, as is conventional in drywall construction, and are concealed with joint compound 34 applied with a taping knife or trowel in the same manner as if applied to ordinary drywall. The panels 20 can be adhesively attached to vertical stud supports when constructing a wall. When dry, the joint compound 34 can be sanded or wet sponged to blend it into the plane of the surface of the face sheet 29.

After the joint compound 34 has been sanded or sponged smooth, the front sheets 29 and remaining joint compound are painted with a commercially available acoustical paint 31 used for painting acoustical tile. An example of a suitable water-based paint, sometimes referred to as a non-blocking paint, is available from ProCoat Products, Inc. of Holbrook, Me. USA, sold under the trademark ProCoustic. An alternative non-blocking or non-bridging acoustically transparent paint or coating 31 can have the following formulation:

| Ingredient | Percentage By Weight | Function |
|---|---|---|
| Water | 61.5 | Solvent |
| Surfactant | 0.003 | Surfactant for TiO2 |
| Starch Thickener | 0.8 | Viscosity modifier |
| Latex Emulsion | 5.0 | Binder |
| Biocide | 0.2 | Preservative |
| Perlite | 7.5 | Aggregate |
| TiO2 | 25.0 | Whitening agent |

The optimal perlite aggregate particle size distribution for this coating is centered around 10-100 mesh for between 60%-80% of its volume, packing density can range from 6 to 8 lbs/cubic foot. The coating 31 can be applied in two coats at a total of 40 to 160 g/square foot, wet with a coverage of about 80 g/square foot being ideal.

The particulate of this coating formulation can produce a slightly textured appearance equal to that of medium to coarse sandpaper lying between about 30 and about 60 grit (by CAMI and FEPA Standards). This low texture can serve to visually effectively conceal the joints between panels. To improve the uniformity of the finished appearance of the ceiling, the taped joints can be covered with strips of the veil fabric 29, wide enough to cover the joint compound, prior to painting. The paint application should leave as much porosity through the layer 29 as is desired but leave the appearance of an essentially imperforate surface to the unaided eye so that the perforations 28 are not seen. More specifically, the paint or coating 31 should be of a non-bridging or non-blocking type capable of wetting the fibers of the veil 29 but not creating a film that bridges from fiber to fiber of the veil. Alternatively, where high NRC is not necessary, satisfactory results can be obtained by using a conventional primer and a coat of interior latex paint 31 to complete the installation of the ceiling 10. When the term monolithic is used herein, it is to denote that essentially the entire visible surface of a ceiling or wall appears to be a seamless expanse without joints.

A ½ or ⅝ in. drywall-based panel 20, having the described perforation arrangement and front and rear sheets 29, and customary space behind the panel can exhibit NRC values up to and above 0.70, a rating equal to the performance of better-grade acoustical ceiling tile.

Presently, the preferred characteristics of the gypsum-based core 24 are:

Thicknesses: 0.5-0.625 in. preferable, optional ⅜ in. to 1 in.

Open area: 9.6-27.7%

Hole diameters: 6-12 mm.

Hole spacing: 15-25 mm.

Following are airflow characteristics of the backer layer 30 of the non-woven SOUNDTEX® material described above and the face layer 29 of the first non-woven scrim material described above before and after painting with a proprietary acoustical coating and the acoustical ProCoustic coating.

| | in. thick | U l/min. | P in. $H_2O$ | v mm/s | U $m^3/s$ | P Pascal | Airflow Resistance R mks acoustic ohms, (Pa · s/$m^3$) | Specific Airflow Resistance r mks rayls, (Pa · s/m) | Airflow Resistivity $r_o$ mks rayls/m, (Pa · s/$m^2$) | Airflow Resistivity $r_o$ MPa · s/$m^2$) |
|---|---|---|---|---|---|---|---|---|---|---|
| Backer | 0.009 | 2.00 | 0.0156 | 16.4 | 3.33E−05 | 3.9 | 116,574 | 236 | 1.09E+06 | 1.09 |
| Unpainted Scrim | 0.019 | 2.00 | 0.0027 | 16.4 | 3.33E−05 | 0.7 | 20,176 | 41 | 8.47E+04 | 0.08 |
| Painted Scrim w/ Proprietary Coating | 0.020 | 2.00 | 0.0143 | 16.4 | 3.33E−05 | 3.6 | 106,859 | 217 | 4.26E+05 | 0.43 |
| Painted Scrim w/ ProCoustic | 0.020 | 2.00 | 0.0144 | 16.4 | 3.33E−05 | 3.6 | 107,606 | 218 | 4.29E+05 | 0.43 |

The tables printed below show NRC values for the inventive board and boards of other constructions for comparison purposes. As in the preceding table, unless otherwise noted, the backer is the SOUNDTEX® material and the face is the first scrim identified above.

TEST I

*Perforated Panel = ⅝ in. FC30 (drywall) with ⅜" diameter perforations, 16 mm o.c. spacing - 27.7% open area

| | Panel Configuration | NRC Mounting | 4FA | NRC |
|---|---|---|---|---|
| A | Perforated panel only | E400 | 0.1967 | 0.20 |
| B | Panel + backer | E400 | 0.6572 | 0.65 |
| BB | Panel + backer used as unpainted face | E400 | 0.6215 | 0.60 |
| H | Panel + backer + unpainted scrim face | E400 | 0.7442 | 0.75 |
| I | Panel + backer + painted scrim face | E400 | 0.7314 | 0.75 |
| E | Panel + backer + paper face | E400 | 0.1978 | 0.20 |
| F | Panel + backer + painted paper face | E400 | 0.2963 | 0.30 |
| G | Panel + painted scrim face | E400 | 0.5772 | 0.60 |
| K | Panel + painted scrim face + unpainted scrim backer | E400 | 0.6376 | 0.65 |
| C | Panel + unpainted scrim face | E400 | 0.4028 | 0.40 |

TEST II

*Perforated Panel = ½ in. Ultralight (drywall) with 6 mm diameter perforations, 15 mm o.c. spacing, 1.5 in. borders - hole pattern = 12.6% open area, overall panel = 9.6% open area

| Panel Configuration | NRC Mounting | 4FA | NRC |
|---|---|---|---|
| Perforated panel only | E400 | 0.1937 | 0.20 |
| Panel + backer + unpainted scrim face | E400 | 0.5947 | 0.60 |
| Panel + backer + painted scrim face | E400 | 0.4825 | 0.50 |

TEST III

Panel A (small holes) = ½ in. Knauf 8/18R with 8 mm. diameter round perforations, 18 mm o.c. spacing & no borders - 15.5% open area
Panel B (large holes) = ½ in. Knauf 12/25R with 12 mm. diameter round perforations, 25 mm o.c. spacing & no borders - 18.1% open area

| Panel Configuration | NRC Mounting | 4FA | NRC |
|---|---|---|---|
| Panel A only (with backer) | E400 | 0.6480 | 0.65 |
| Panel B only (with backer) | E400 | 0.7191 | 0.70 |
| Panel A + backer + unpainted scrim face | E400 | 0.6245 | 0.65 |
| Panel B + backer + unpainted scrim face | E400 | 0.6810 | 0.70 |
| Panel A + backer + painted scrim face | E400 | 0.5782 | 0.60 |
| Panel B + backer + painted scrim face | E400 | 0.5652 | 0.55 |
| Panel A + backer + painted scrim face over 1 in. fiberglass panel | E400 | 0.6192 | 0.60 |
| Panel B + backer + painted scrim face over 1 in. fiberglass panel | E400 | 0.6031 | 0.60 |

Panel E of Test I had a heavy manila paper face with a basis weight of 263.50 gm/$m^2$, a caliper of 17.22 mils, a density of 0.60 c/$m^3$ and a porosity of 58.97 seconds. This test sample illustrates that a face, although porous, but with too high an air flow resistivity is unsuitable for use with the invention. Panel BB of Test I indicates that a face with a higher air flow resistivity (see above table) than a painted scrim face can achieve a satisfactory NRC.

The acoustical panel of the invention can be manufactured in additional ways and with different constructions, but maintaining the perforations effectively restricted on at least the face (room) side of a completed panel. For example, where high NRC values are not needed, the rear layer 30 may be omitted. Porous paper may be substituted for either of the non-woven layers 29, 30.

Figure 3:
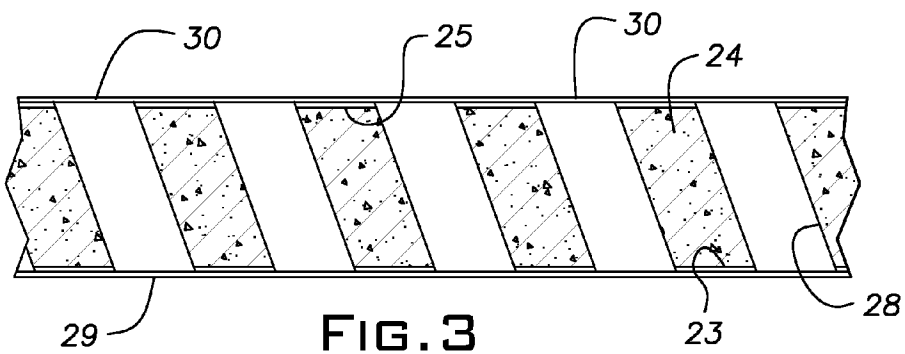
FIG. 3 is a fragmentary, enlarged, cross-sectional view of a modified form of an acoustical panel of the invention.

It has been further discovered that NRC can be measurably increased by orienting the perforations obliquely to the plane of the panel. Such a construction is illustrated in FIG. 3. The perforations 28 can, for example, be oriented at 20 degrees off a line perpendicular to the plane of the panel. The reason or reasons for this improved acoustical performance is not presently completely understood, but could be the result of a greater perforation volume and/or internal reflection of sound waves due to the oblique angle, and/or a greater effective open area at the face.

Figure 4:
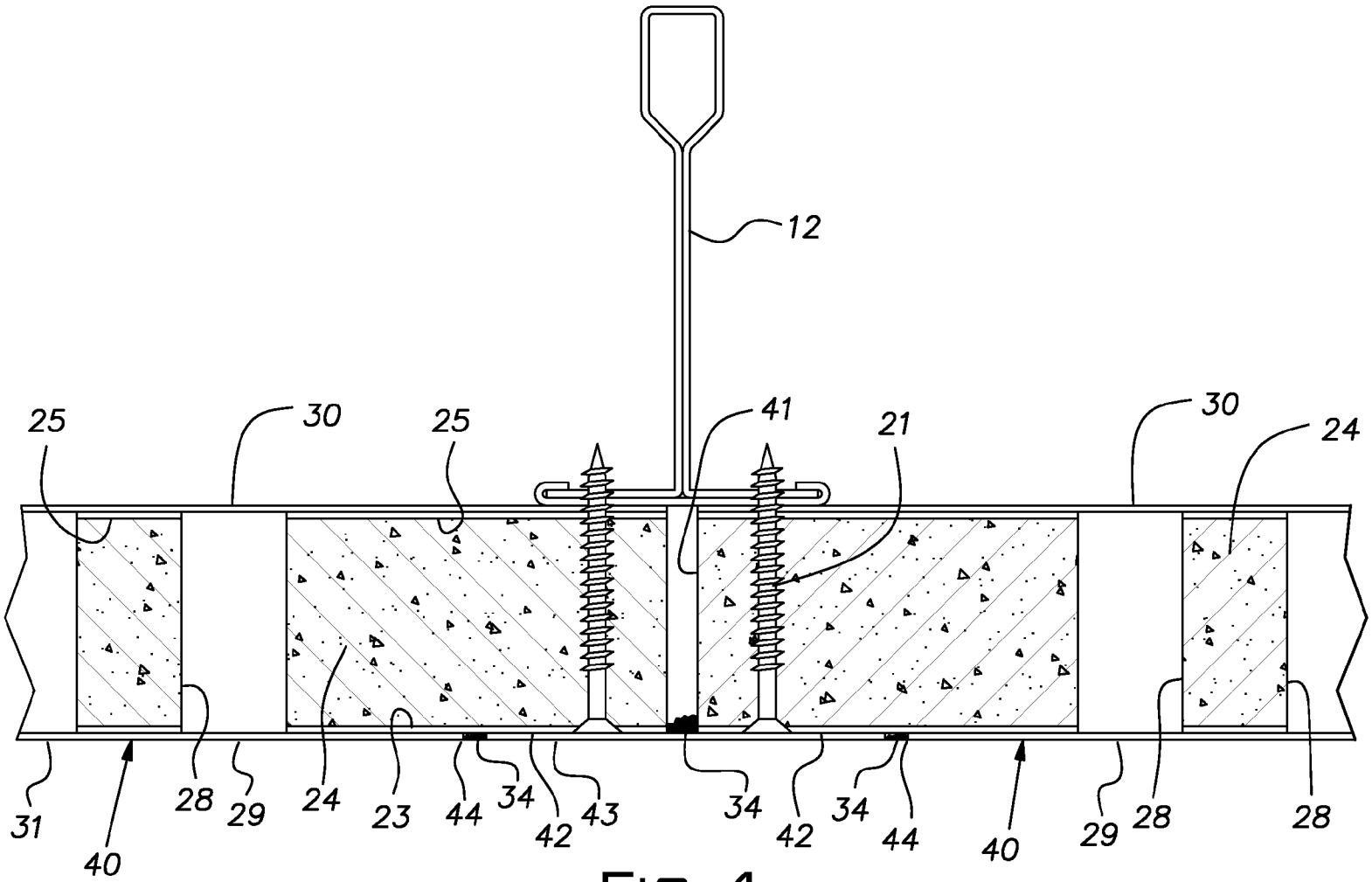
FIG. 4 illustrates a modified panel joint construction.

Referring to FIG. 4, an alternative joint construction is illustrated where edges 36 of two adjacent panels 40 are shown in cross-section. The same reference numerals are used in FIG. 4 as used in FIG. 2 for identical elements. The panels 40 are the same as the panels 20 except that they are of the "square edge" type where the margins of the long panel edges are not tapered to receive a tape as they are on the panels 20. The glass fiber veil 29, which is adhered to the paper face 23 with a suitable adhesive such as an emulsion of polyvinyl acetate marketed under the mark ELMERS® by Elmer's Products, Inc. The veil 29 is dimensioned so that it is spaced, for example, 1 inch, from the edge of a panel leaving a margin 42. Any narrow gap 41 that exists between the panels 40 that is either unavoidable or intentional can be partially or substantially completely filled with drywall joint compound 34 which, preferably, is a setting, non or low shrinkage, sandable type such as disclosed in the following patents: U.S. Pat. No. 6,228,163; U.S. Pat. No. 5,746,822; U.S. Pat. No. 5,725,656; U.S. Pat. No. 5,336,318; and U.S. Pat. No. 4,661,161. The gap 41 is filled by the joint compound 34 flush with the outer surface of the front paper face 23. Alternatively, the gap 41 can be left without partially or fully fitting it with joint compound.

A tape 43 made of the same material as the veil 29 can advantageously be used to span the joint or gap 41 between the panels 40. The width of the tape 43 is less than the combined width of the marginal areas 42 of the panels. Where the panel margins 42 uncovered by the veil 29 are 1 inch wide, the veil tape 43 can be, for example, 1¼ inch wide. The tape 43 can be adhered, for example, by the same adhesive used to join the veil 29 to the paper face 23 or with joint compound.

Use of square edge drywall panels 40 and non-shrinking settable joint compound reduces the time and labor in constructing a ceiling or wall of the invention. The spaces between the longitudinal edges of the tape 43 and edges 44 of the panel veils 29 can be filled with joint compound, preferably of the quick-setting, non-shrinking type. The veil 29, 43 covering the panels 40 is then coated, preferably by spraying, with one of the paint or coating materials 31 described above.

Figure 5:
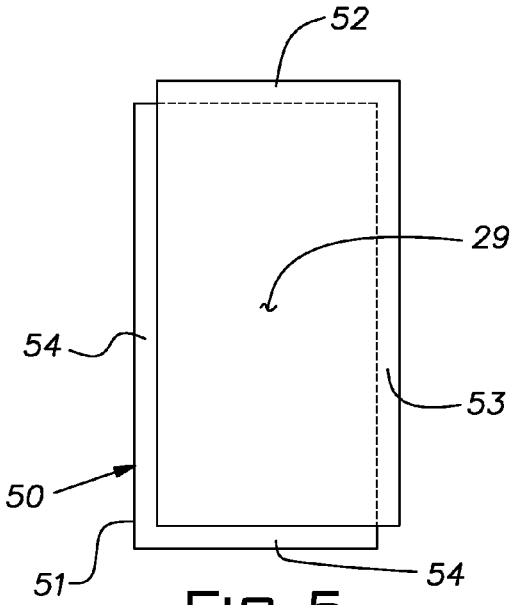
FIG. 5 illustrates an aspect of the invention where the veil or scrim attached to one rectangular panel is staggered to overlap the joints of the panel with two adjacent panels.
Figure 6:
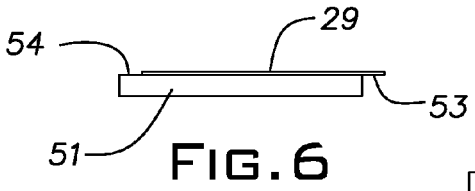
FIG. 6 is an edge view of the panel of FIG. 5.
Figure 7:
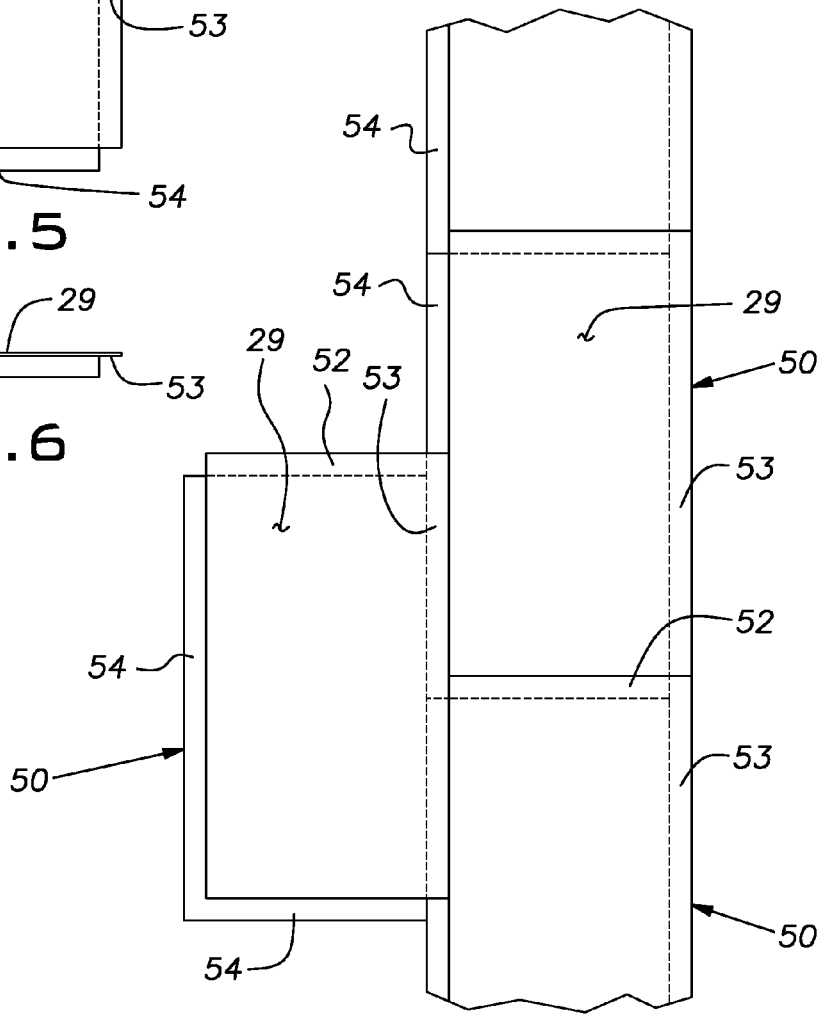
FIG. 7 shows a plurality of the panels of FIG. 6 in an assembled relation.

FIGS. 5-7 illustrate a modified acoustical panel 50 that differs only from the panel 40 described in connection with FIG. 4 by the size and position of the veil 29. The veil 29 is slightly smaller in its planar dimensions than the corresponding planar dimensions of the rectangular main body or remainder 51 of the panel 50 to which it is adhered. Additionally, the veil 29 is offset from the main body 51 along two intersecting edges 52, 53 so that these edges are cantilevered or free and not directly adhered to the main body.

The panel 50 is assembled with identical panels to construct a wall, ceiling or like acoustical barrier. Cross joints associated with the edges 52 can be staggered in relation to adjacent panels joined at edges 53. It will be seen that the cantilevered part or edge 52 and 53 of the veil 29 bridges the actual joint existing between the main bodies 51 of adjacent, abutting panels. Prior to placement of a panel 50 that will provide an overlying veil edge 52, 53, marginal areas 54 not covered by the veil 29 of a previously placed panel 50 are coated with a suitable adhesive, such as discussed above. After placement of this next panel 50, its free veil edges 52, 53 can be pressed on the adhesive on the margins 54 of the previously placed panels 50. The offset veil arrangement of the panel 50 can eliminate the labor of taping joints between panels and has the potential of producing joints that are invisible or nearly invisible to the eye of an observer. Only a very small gap, generally equal to the selected small difference in the size of the veil 29 compared to the main body 51, will be present between adjacent edges of the veils of joined panels 50. While the various FIGS. illustrate rectangular panels that are larger in one planar dimension than a perpendicular dimension, it is to be understood that square panels are intended to be covered within the meaning of the term "rectangular".

The foregoing disclosures involve modification of a conventional drywall sheet to convert it to the acoustical panel of the invention. However, the inventive acoustical panel can be originally manufactured with perforations in the gypsum core while it is being originally formed or immediately after it is formed and prior to attachment of one or both cover sheets or layers, if any, to its front face and rear side. The perforations, for example, can be cast into the gypsum body. The cross-section of the perforation in the various disclosed embodiments can be accircular when not drilled.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. An acoustical panel comprising a drywall sheet of a thickness of at least ½ inch or metric industry equivalent having a gypsum-based core and paper front and rear face layers, the drywall sheet being perforated through its faces and core with holes at least ⅛ inch in diameter and of sufficient number to comprise at least 9% of a face area of the panel, the front face being covered by a porous non-woven glass fiber veil having a translucence rendering it incapable of fully concealing the holes, the veil being covered with a non-bridging coating, the combined veil and coating being effective to conceal the holes while affording sufficient porosity therethrough to allow the panel to exhibit an NRC of at least 0.55.

2. An acoustical panel as set forth in claim 1, wherein the rear face layer is covered with an acoustical non-woven fabric.

3. An acoustical panel as set forth in claim 1, wherein the panel is joined with closely adjacent or abutted identical panels forming a wall or ceiling, the joints between adjacent panels being covered with a tape covered with said non-bridging coating.

4. A combination of acoustical panels as set forth in claim 3, wherein the tape covering said joints is made of the same material as the material of said veil.

5. An acoustical panel as set forth in claim 2, wherein said drywall sheet is of a square edge style.

6. A combination of acoustical panels as set forth in claim 3, wherein areas between the tape and veil is filled with a joint compound.

7. A combination of acoustical panels as set forth in claim 3, wherein said coating is a water-based product including particles that produce a moderate texture when dry.

8. A combination of acoustical panels as set forth in claim 7, wherein the particles produce a dry coating having a texture of 30-60 grit sandpaper.

9. A rectangular acoustical panel having a sound absorbing main body, a glass fiber acoustical veil having planar dimensions substantially equal to planar dimensions of the main body, the veil being adhesively attached to the main body and offset therefrom whereby two of its intersecting edges are cantilevered from the main body and another two of its edges are spaced from respective edges of the main body leaving marginal areas of the main body associated with the another two edges uncovered by the veil, the cantilevered edges of the veil each being adapted to overlie a joint formed between the main body and a main body of a panel identical to said first-mentioned panel.

* * * * *